United States Patent [19]

Rostron

[11] 4,123,635

[45] Oct. 31, 1978

[54] MULTI-POLE HIGH-VOLTAGE CIRCUIT-INTERRUPTER HAVING INDEPENDENT POLE TRIPPING WITH A SINGLE COMMON OPERATING MECHANISM

[75] Inventor: Joseph R. Rostron, Monroeville, Pa.

[73] Assignee: Westinghouse Electric Corp., Pittsburgh, Pa.

[21] Appl. No.: 646,796

[22] Filed: Jan. 6, 1976

[51] Int. Cl.[2] ..... H01H 33/28

[52] U.S. Cl. ..... 200/148 F; 200/148 R; 200/77; 200/78; 200/153 G; 200/82 A

[58] Field of Search ..... 200/148 R, 82 A, 153 G, 200/148 F, 77, 78

[56] References Cited

U.S. PATENT DOCUMENTS

| | | | |
|---|---|---|---|
| 3,315,189 | 4/1967 | Heft et al. | 200/153 G |
| 3,564,174 | 2/1971 | Clarke | 200/77 |

*Primary Examiner*—Robert S. Macon
*Attorney, Agent, or Firm*—W. A. Elchik

[57] ABSTRACT

A multi-pole high-power circuit-interrupter is provided having a single common operating mechanism therefor, and having independent pole tripping operation by associating with at least one of a plurality of the pole-units its independent ball latching means, which may be very quickly mechanically released upon a tripping operation associated with the respective one pole-unit to which said ball latching device is connected.

Another important feature of the invention is the provision of a plurality of load-release latching balls, which may be quickly released from their latched position by a pneumatic releasing device, which is energized in response to electrical overload conditions existing in the respective pole-unit to provide thereby a tripping operation for the particular pole-unit, to which the ball-latching releaseable device is mechanically connected.

Still another feature of the present invention is the provision of a spring-return catch-member in a ball-latch releasing device, which holds the load-release balls in their latched position, and provides a desirable quick relatching operation at the end of the closing operation of the circuit-interrupter.

6 Claims, 9 Drawing Figures

FIG.1.
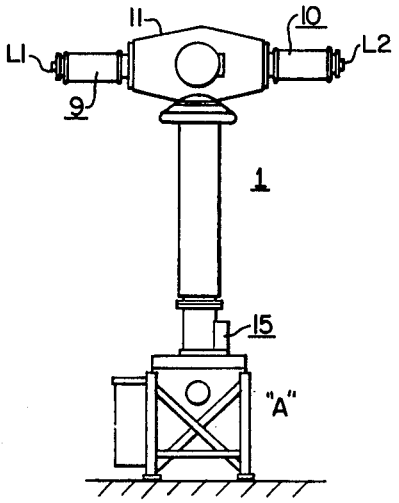
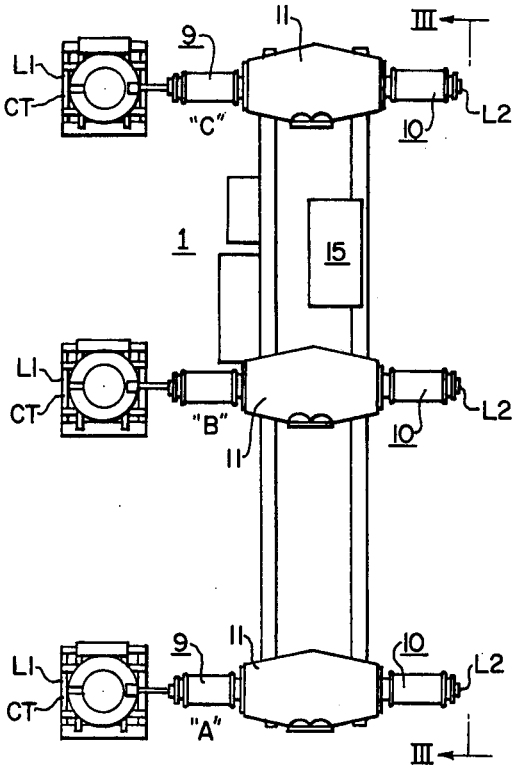
FIG.2.
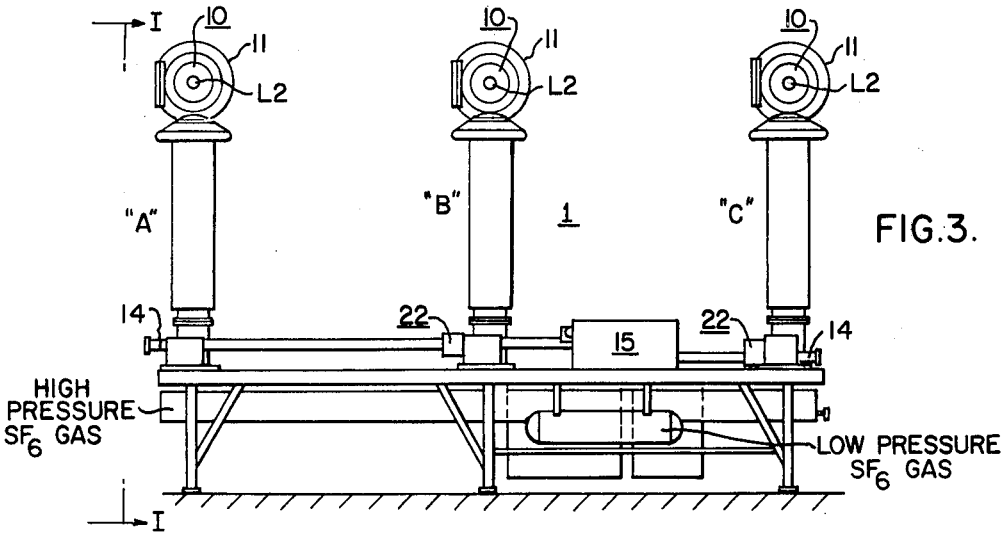
FIG.3.

CLOSED POSITION

LATCHED CONDITION

BIASED OPEN BY SPRINGS 4,14 AND 16
HIGH PRESSURE
VALVE CLOSED
REMAINS STATIONARY DURING RELEASE OF LATCH BALL 28
22
21a
21
23
24
26
28
30
31
32
32a
33
34
35
36
37
38
40
41
42
43
44
45
46
47
48
50

MULTI-POLE HIGH-VOLTAGE CIRCUIT-INTERRUPTER HAVING INDEPENDENT POLE TRIPPING WITH A SINGLE COMMON OPERATING MECHANISM

CROSS-REFERENCES TO RELATED APPLICATIONS

Reference may be made to a related patent application filed Jan. 6, 1976, Ser. No. 646,797 by W. B. Freeman, entitled "Multi-Pole High-Voltage Circuit-Interrupter Having Independent Pole Tripping With a Single Common Operating Mechanism", and assigned to the assignee of the instant invention.

SUMMARY OF THE INVENTION

In accordance with the present invention, a multi-pole high-voltage circuit-interrupter, utilized for interrupting multi-phase electrical circuits, has a common operating mechanism for simultaneously opening and closing the contacts provided within each of the several pole-units. Associated preferably with at least one of the pole-units, and controlling its independent tripping opening operation, is a releaseable ball latching tripping structure, which enables the independent pole-tripping operation for said one of the pole-units independently of the other associated pole-units, should an electrical fault current pass through said one particular pole-unit. This has the important desirable advantage that should the contacts of one of the pole-units remain closed due to mechanical failure, and therefore is unable to open, nevertheless at least one of the other two associated pole-units will, through the intermediary of its independent releaseable ball tripping latching system, quickly open, to thereby open at least one of the other two phases of the three-phase circuit, and thus improve the power system stability and allow additional time to actuate backup breakers to isolate the fault from the power system prior to an instability occurring on the power system and thus causing a system wide power outage.

Another feature of the present invention is the utilization of a releaseable latching device utilizing a plurality of load-release latching balls, which are maintained in their latched position by a movable catch member which is, preferably, responsive to pneumatic conditions, and when so pneumatically actuated, permits a resultant releasing action of the load-release balls to a deactivated, unlatching position, thereby unlatching the latching device and providing an immediate tripping operation.

BRIEF DESCRIPTION OF THE DRAWINGS

FIG. 1 is a side-elevational view of an end pole-unit of a three-phase circuit-interrupting structure;

FIG. 2 is a top plan view looking downwardly upon the three pole-units of the three-phase interrupting assemblage of FIG. 1;

FIG. 3 is a side-elevational view of the three pole-units of the three-phase interrupting assemblage of FIG. 1, indicating the location and disposition of the ball-release latching devices constituting a part of the instant invention;

DESCRIPTION OF THE PREFERRED EMBODIMENT

Figure 4:
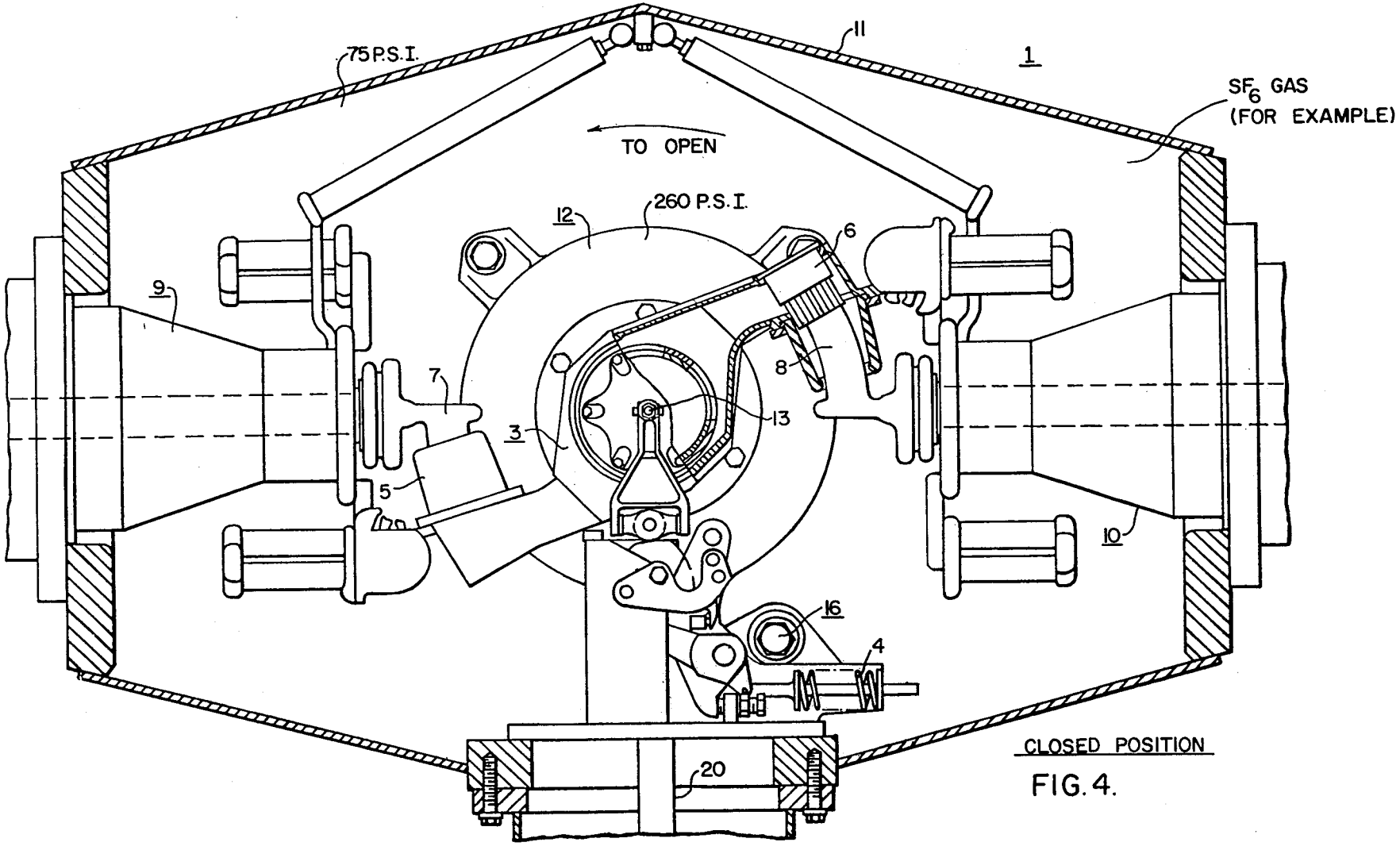
FIG. 4 is a considerably-enlarged view taken through the contact structure provided in one of the interrupting heads, indicating the separable contact structure therein in the closed-circuit position.

Referring to the drawings, and more particularly to FIGS. 1–7 thereof, it will be observed that there is provided a high-voltage three-phase compressed gas circuit-interrupter 1 of the type set forth in U.S. Pat. No. 3,457,530, issued July 22, 1969 to R. C. Van Sickle, and assigned to the assignee of the instant application. Generally, the contact construction of the high-voltage interrupter 1 of FIGS. 1–3 is set forth in FIG. 4, which shows the rotating movable contact-arm construction 3, in which a pair of serially-related movable contacts 5, 6 are separable from a pair of spaced relatively-stationary contacts 7, 8, the latter being connected to the inner ends of a pair of terminal-bushings 9, 10, extending laterally outwardly through a metallic interrupter casing 11. During the opening operation, and as set forth in said U.S. Pat. No. 3,457,530, the two movable contacts 5, 6 separate from the two relatively-stationary contacts 7, 8, drawing two arcs in series, and establishing a gas-flow from a high-pressure gas-reservoir chamber 12, extending on the axis 13 of the movable contact assembly 3. Reference may again be made to said U.S. Pat. No. 3,457,530 for a detailed description.

Figure 5:
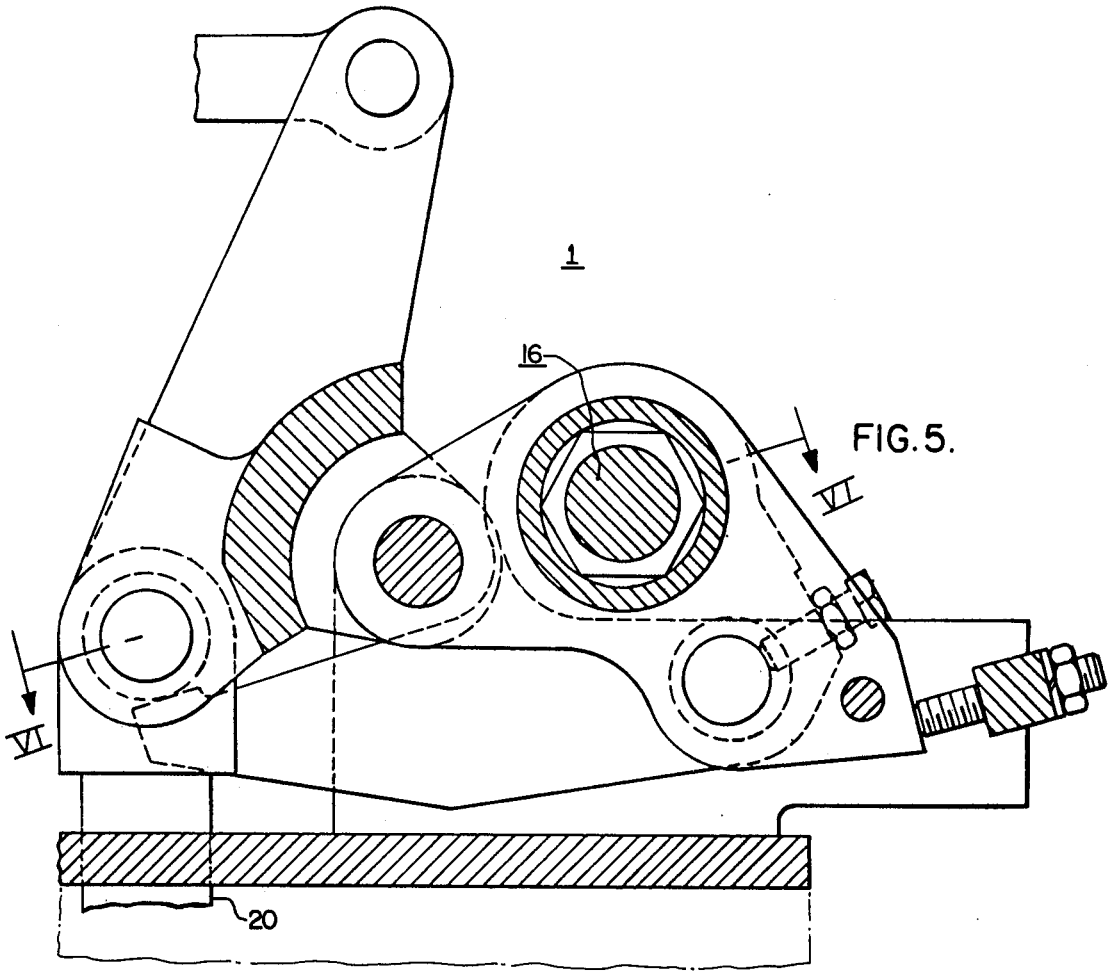
FIG. 5 is a detailed view of the contact operating crank-arm assemblage utilized within the interior of the interrupting head, illustrated in FIG. 4, for operating the movable contacts.
Figure 6:
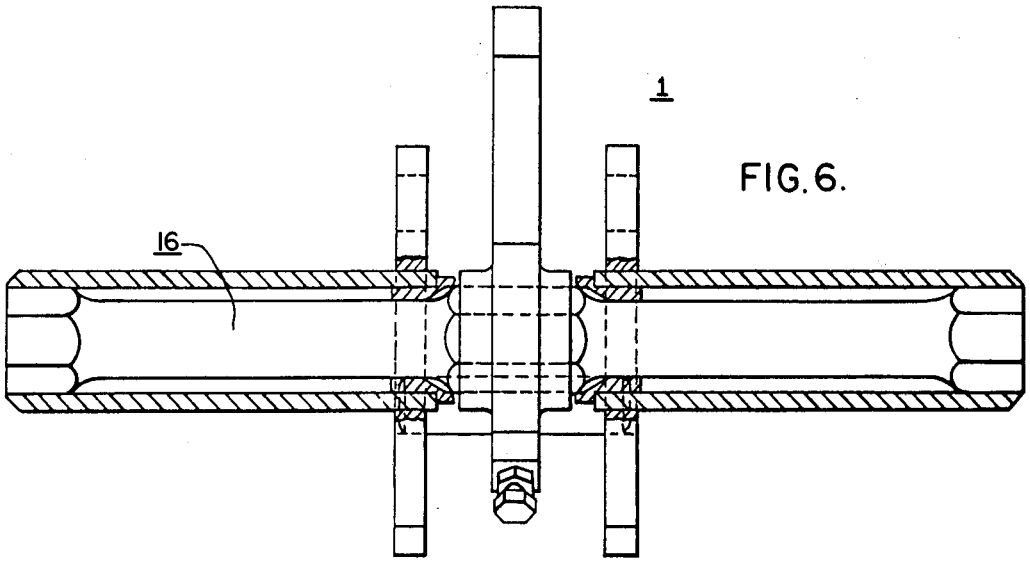
FIG. 6 is a view taken substantially along the line VI—VI of FIG. 5, indicating the accelerating compression-spring means and the torsion-bar construction.
Figure 9:
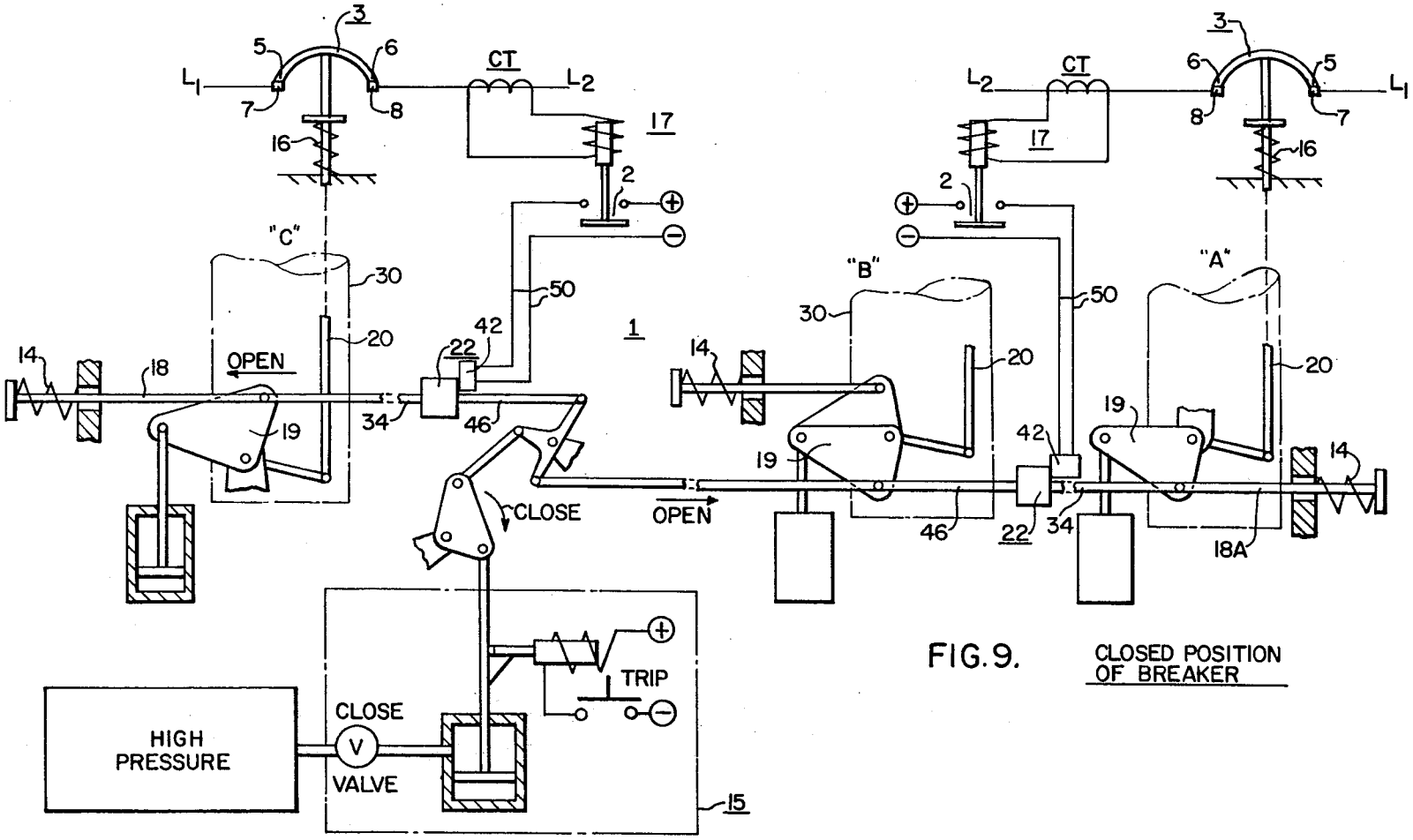

It will be observed, with reference to FIGS. 4–6, that in the closed-circuit position of the contact structure of FIG. 4, that the contacts 5, 6 are under considerable accelerating spring pressure tending to effect their opening motion. This is not only provided by a pair of remote "tail" springs 14 (FIG. 9), associated with the ground-operating mechanism 15, but, importantly, a heavy torsion-bar 16, as set forth more clearly in FIGS. 5 and 6 is provided and also an additional opening accelerating spring 4 located within the "head" 11, as shown in FIG. 4. This provides a tremendous accelerating "kickoff" spring-action at the contact structure 3 itself, enabling thereby a very fast initial opening operation to be achieved, which, subsequently, is carried out by the aforementioned high-voltage accelerating spring 4 and the remote "tail" springs 14, disposed at the ends of the ground-operating rods 18, 18A at ground potential, as shown in FIG. 9.

To provide, as mentioned, independent pole operation, there is associated with each of the end pole-units "A" and "C" a ball-releasing device 22, which is pneumatically actuated and described more fully hereinafter.

Figure 7:
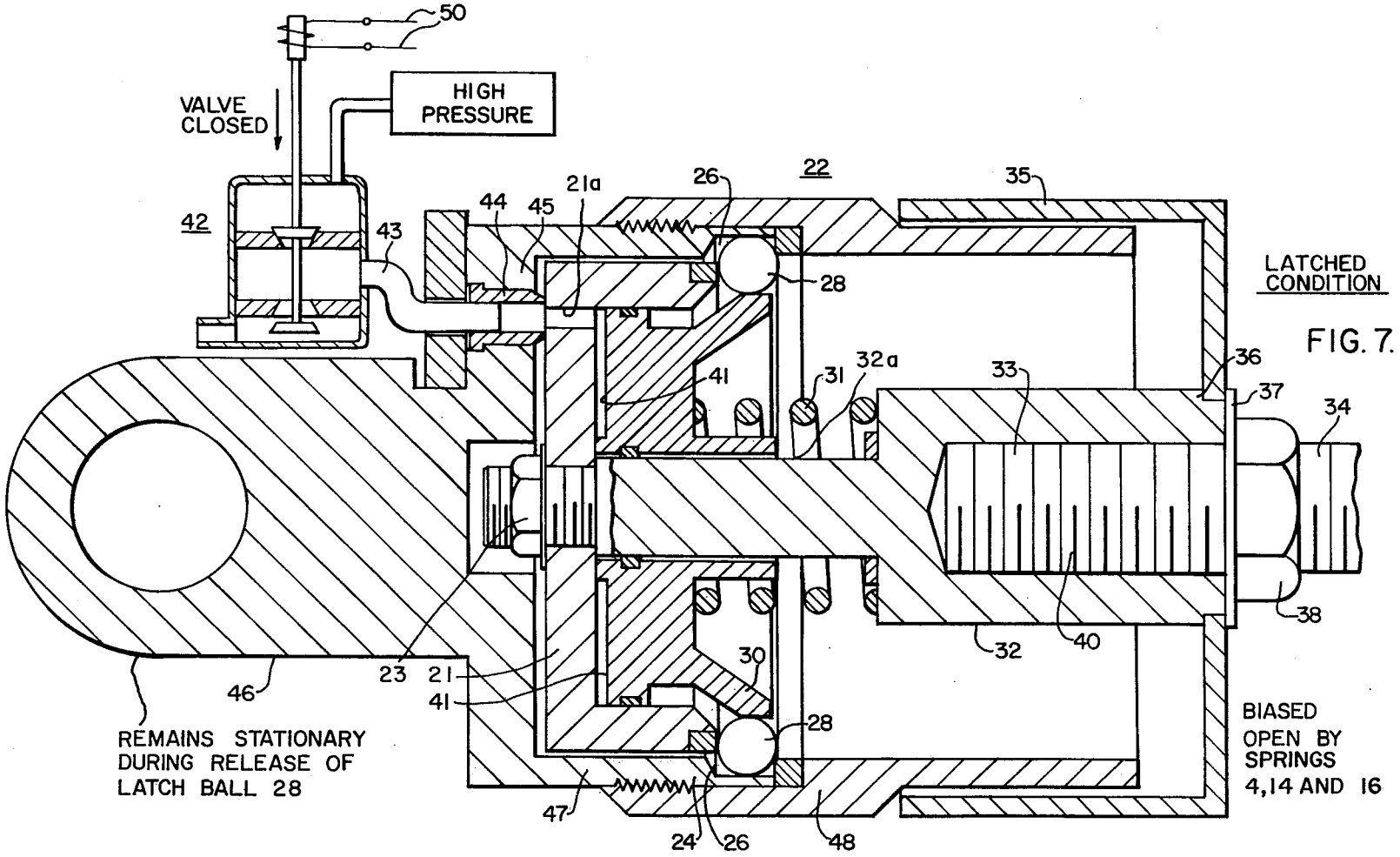
FIG. 7 is a considerably-enlarged vertical sectional view taken through one of the ball-release latching devices with the load-release balls being shown in their latched position.

In more detail, the releasing device 22 includes a cylindrically-shaped captivating cage, or cylinder 24 having internally-disposed ball-recess portions 26, within which are a plurality of load-release balls 28 maintained radially outwardly in a latching captive position by a pneumatically-actuated ring-shaped catch-member 30. This catch-member 30 is spring-biased into a an extended latching position by a compression spring 31 seating against the end of a collar member 32, in turn threadedly attached to an end 33 of an operating rod 34, which connects to the contacts by the bell-crank members 19 and operating rods 20. A cylindrical dust-cover 35 may be interposed between a shoulder portion 36 of the cylinder 32 and a washer 37 held in place by a nut 38. As shown in FIG. 7, the nut 38 threads onto the threaded end stud-portion 40 of the operating rod 34 connected to the contacts 5, 7 and 6, 8 by way of the bell-crank members 19 and upstanding operating rods 20.

In addition, the operating rod 34 threads into the internally threaded sleeve member 32 having a reduced shank portion 32*a*, the latter having an apertured cup-shaped thrust member 21 threadedly secured thereto and clamped fixed in place by a clamping nut 23.

Figure 8:
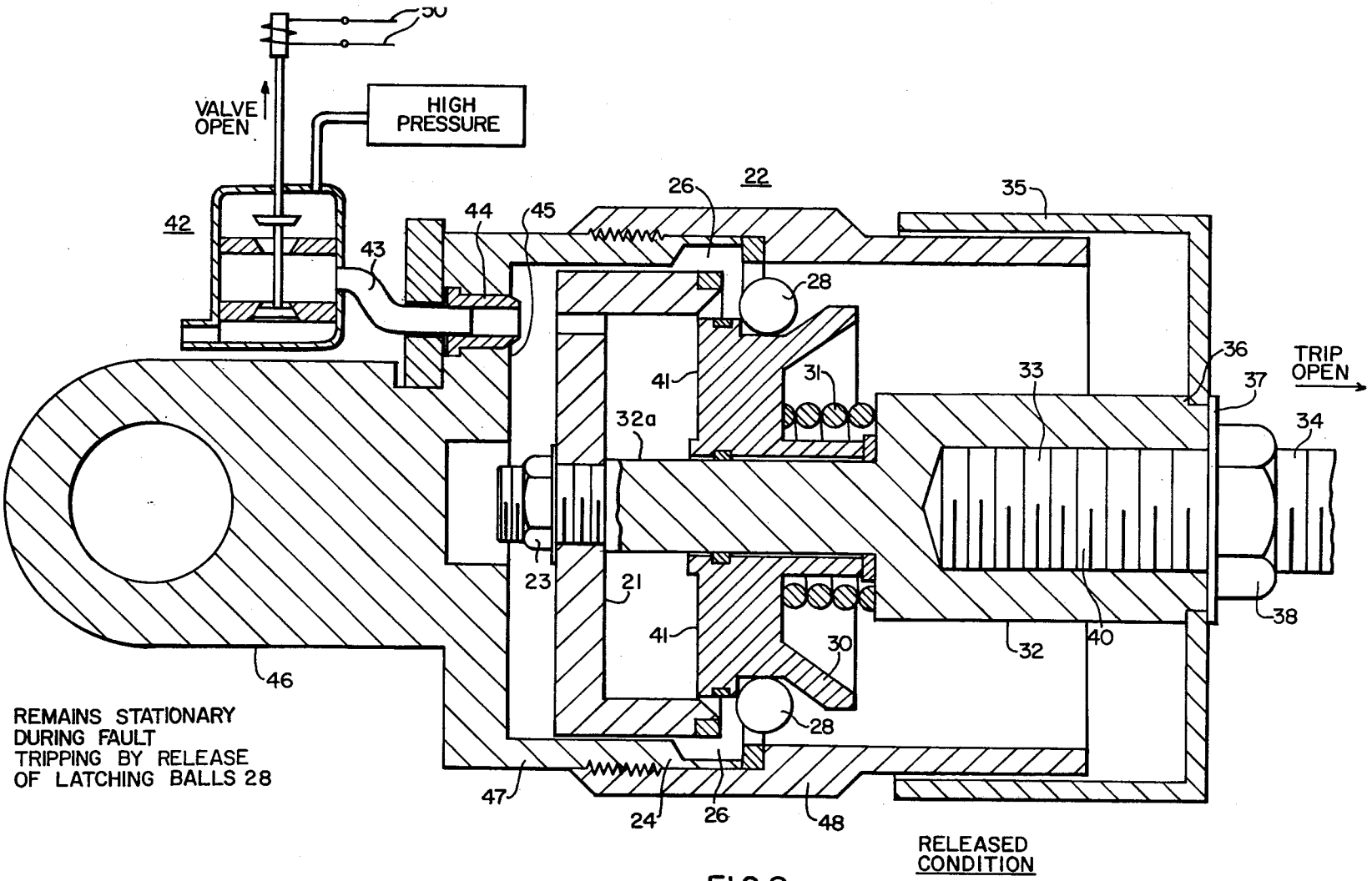
FIG. 8 is a view similar to that of FIG. 7, but indicating the released position of the latch-load balls in their unlatched, or released position in response to the pneumatic operation of the pneumatically-actuated catch member; and, FIG. 9 is a diagrammatic view indicating the wiring connections for the three-pole circuit-breaker device.

The annular ring-shaped spring-biased catch-member 30 is pneumatically activated by having a piston portion 41, provided at its left-hand end, as viewed in FIG. 7, which may be actuated pneumatically toward the right, as viewed in FIG. 7, to a load-release position, as shown in FIG. 8, by the entrance of high-pressure gas through a solenoid valve 42, which may be electrically actuated by a fault current passing through either of the particular pole-units "A" and "C".

In more detail, the individual current transformer CT will close the contacts 2 (FIG. 9) of the overcurrent relay 17 to energize the overcurrent electrical lines 50 and electrically actuate the pneumatic valve 42 of the respective affected pole-unit "A" or "C".

A flexible high-pressure pneumatic line 43 preferably connects to the solenoid-valve device 42, so that when the valve 42 is opened as a result of a fault current passing through either pole-unit "A" or "C", high-pressure gas passes through the nipple 44, through the end-plate portion 45 and through apertures 21*a* of the thrust member 21 to act upon the piston surface 41 of the annular catch-member 30, as shown in FIG. 7.

The rod 46 to the mechanism 15 has a cup-shaped portion 47, which is threadedly secured to the cylindrical ball-retainer cage 24, so that when the catch-member 30 is in its leftward ball latching position, the load-release balls 28 are captivated, and thus maintain the latching device 22 in its collapsed latched condition, as shown in FIG. 7.

On the other hand, when high-pressure gas passes through the solenoid-valve 42, when the latter is electrically actuated by a fault-current condition as reflected by energization of the control lines 50 (FIG. 9), the catch-piston member 30 will move toward the right, compressing the return spring 31, and permitting radial inward releasing action to be exerted upon the latch balls 28, thereby permitting the latching device 22 to thus expand to the released unlatched condition, as illustrated in FIG. 8 thereby permitting the faulted pole-unit "A" or "C" to open its contacts even though the common operating mechanism is closed at this time.

Following a release of the latching device 22, thereby resulting in a trip-open operation of the respective affected circuit-breaker pole-circuit "A" or "C", means are provided, not shown, to effect a subsequent opening of the main common operating mechanism 15. This will effect a forceful rightward opening motion of the operating rod 46 and latching sleeve 25 of FIG. 8, to thereby relatch the tripping balls 28, it being remembered that the catch-piston member 30 is biased at this time to a relatching position by the relatching spring 31 of FIG. 8.

Following such a relatching action at the end of the opening operation of the circuit-breaker 1, and the main common mechanism 15 thereafter, a subsequent closing operation of the breaker 1, will close all three pole-units "A", "B" and "C" under spring pressure, since the latching devices 22 at this time (the time of closing the breaker) will already have been relatched to their retracted, shortened latched position, as shown in FIG. 7.

From the foregoing it will be observed that one important advantage results by the independent pole operation, in that two of the interrupters "A" and "C" have their own independent individual ball latching mechanisms 22, which are individually, independently operated, separate and apart, from the other pole-units. In other words, two of the pole-units "A" and "C" have their own latching tripping devices 22, which independently permits an expansion or unlatching of the respective ball latching device 22 associated with that particular pole-unit, and thereby permitting a tripping opening operation of the respective contacts 5,7 and 6,8 within that particular faulted pole-unit.

With referrence to FIG. 9, it will be observed that the occurrence of a fault-current condition through either of the two pole-units "A" or "C" will electrically actuate the respective solenoid device 42 and thus open the effected pole-unit. Preferably, there is one latching device 22 for each of the end pole-units "A" and "C", as illustrated in FIG. 3.

Although there has been illustrated and described a specific latching structure 22, it is to be clearly understood that the same was merely for the purpose of illustration, and that changes and modifications may readily be made therein by those skilled in the art, without departing from the spirit and scope of the invention.

What I claim is:

1. The combination in a multi-pole high-power high-voltage circuit-interrupter assemblage having a plurality of pole-units ("A", "B", "C") each with its separable arcing contacts, adaptable for interrupting multi-phase high-voltage circuits of considerable amperage, of a single common operating mechanism at ground potential for simultaneously effecting the opening and closing operations of the several arcing contacts for all of the several pole-units, a mechanical interconnecting operating linkage positively connected between the individual pairs of separable arcing contacts of the several pole-units and said single common operating mechanism situated at ground potential, an independently-operated ball-release latching means (22) interposed in said positive interconnecting operating linkage (20, 34, 46) for at least one of said pole-units, means responsive to a fault condition existing in said one pole-unit to release said independently-operated ball-release latching means (22) to thereby trip the said one affected faulted pole-unit open independently of the condition of said single common operating mechanism at ground potential.

2. The combination of claim 1, wherein the ball-release latching means includes an outer ball-retainer cage having a plurality of ball-recesses therein, an inner pneumatically-actuated ball-catch device, and said ball-catch device having a piston-face portion responsive to pressure conditions.

3. The combination of claim 2, wherein the ball-catch device is spring returned to its latching position.

4. The combination of claim 3, wherein an electrically-actuated solenoid-valve device admits or prevents gas pressure against said piston portion of the ball-catch member.

5. The combination of claim 1, wherein a ball-retainer cage (24) is positively secured to the operating mechanism (15) a thrust member (21) is secured to the movable contacts of the circuit-breaker and carry a movable ball-catch latching device (30) thereon having lost-motion, and spring means (31) being provided for biasing the ball-catch latching device (30) into a ball-latching position.

6. The combination according to claim 5, wherein an electrically-actuated solenoid valve (42) controls the admission of high-pressure gas through the thrust member and against the piston surface of the ball-catch member (30).

* * * * *